United States Patent [19]

Czeczerski

[11] Patent Number: 4,899,939

[45] Date of Patent: Feb. 13, 1990

[54] DEVICE FOR THE APPORTIONING OF WASHING AGENTS IN HAND HELD SHOWER HEADS

[76] Inventor: Nordfried Czeczerski, Freinsheimer Strasse 88, 6710 Frankenthal 4, Fed. Rep. of Germany

[21] Appl. No.: 235,659

[22] Filed: Aug. 24, 1988

[30] Foreign Application Priority Data

Aug. 24, 1987 [DE] Fed. Rep. of Germany ... 8711446[U]

[51] Int. Cl.[4] ..... B05B 1/18

[52] U.S. Cl. ..... 239/310; 239/315; 239/317

[58] Field of Search ..... 239/310, 315, 316, 317, 239/318; 137/268, 599.1

[56] References Cited

U.S. PATENT DOCUMENTS

| | | | |
|---|---|---|---|
| 1,517,926 | 12/1924 | Weckesser | 239/310 |
| 2,797,132 | 6/1957 | Alpert | 239/315 |
| 3,042,312 | 7/1962 | Packard | 239/315 |
| 3,777,982 | 12/1973 | Britton | 239/315 |
| 4,171,169 | 10/1979 | Williams | 239/315 |

*Primary Examiner*—Robert J. Oberleitner
*Assistant Examiner*—Karen B. Merritt
*Attorney, Agent, or Firm*—Kinzer, Plyer, Dorn, McEachran & Jambor

[57] ABSTRACT

A device for apportioning washing agents in hand held shower heads. The device includes a canister casing having an open end. A water inlet leads into the container casing. A water flow sleeve extends through the container casing. An annular washing agent cavity is located between the container casing and the flow sleeve. An outlet cap assembly is attached to the container casing to close the open end of the casing. The outlet cap assembly has a first member with a cylindrical passage which surrounds the water flow sleeve and is spaced from the sleeve to create a gap which provides an outlet for the washing agent cavity. A water inlet passage is provided for the washing agent cavity and leads to the container casing water inlet. A bolt is positioned between the water flow sleeve and the water inlet. The bolt has a bore extending therethrough, which bore has a wider entrance portion adjacent the water inlet. The bolt is slidable between a first position in which the bore connects the water inlet with the water flow sleeve and a second position in which the wider entrance portion of the bore connects the casing water inlet with the water inlet passage for the washing agent cavity. A detent is provided to hold the bolt selectively in either of its first or second positions.

3 Claims, 1 Drawing Sheet

Fig. 1
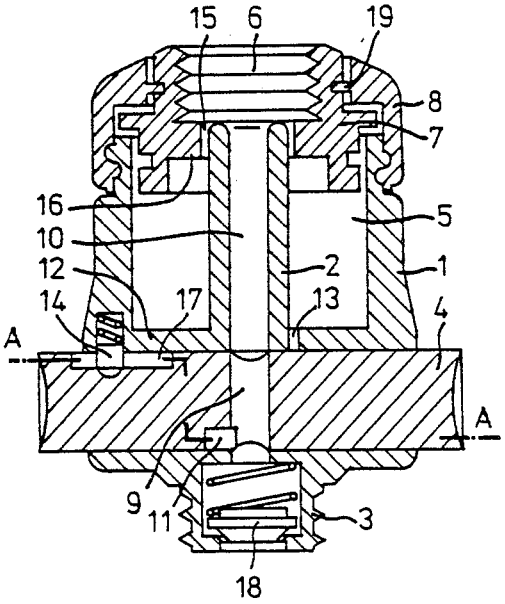
Fig. 3
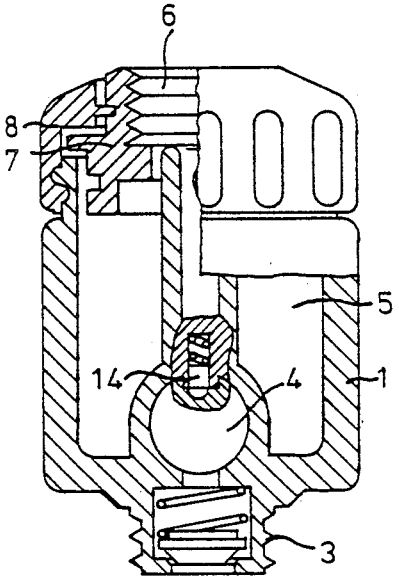
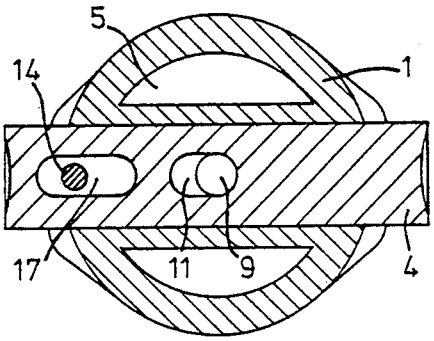
Fig. 2
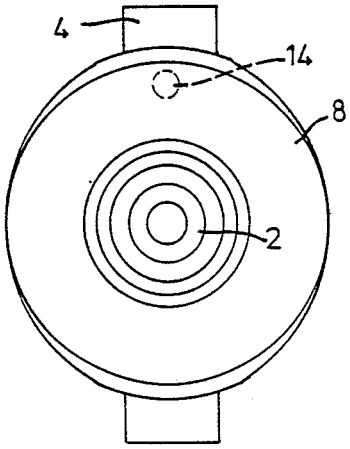
Fig. 4

DEVICE FOR THE APPORTIONING OF WASHING AGENTS IN HAND HELD SHOWER HEADS

BACKGROUND AND SUMMARY OF THE INVENTION

The invention relates to a device for the apportioning of washing agents in hand held shower heads.

A hand held shower head is known in which the shower head has an approximately cylindrical casing, on which there is emplaced a washing agent container. The tubular formed hand grip serves as water feed line and in the hand grip there is present a regulating valve with which the water feed on the shower head can be adjusted as, for example, the washing agent is rinsed out from the washing agent container with the shower jet. The disadvantage of this known form of execution lies in that the arrangement for the apportioning of washing agents is installed directly in the hand held shower head, so that a subsequent installation of such an arrangement is not possible. It is always necessary then to change the entire hand shower head.

Underlying the invention is the problem of providing such a device which can subsequently be installed on any arbitrary shower head.

This problem is solved according to the invention by the means that a container-type casing is provided which is provided with a water flow sleeve, surrounding which there is arranged a washing agent cavity, in which system a connecting piece is mountable onto the casing, which connecting piece has a cylindrical passage surrounding the flow sleeve and spaced a small distance therefrom to provide an annular gap for the passage of the washing agent and that the washing agent container is connected with the water flow by means of a rinsing passage.

An advantageous form of execution consists in that in the casing extending transversely to the flow sleeve, there is provided a slidable switching bolt in a transversely-extending tube, which is provided with a radial bore forming an extension of the flow sleeve and which bolt may be moved in the transverse tube between stop positions.

Further it is proposed that the bore in the switching bolt is provided with a laterally-enlarged entrance and that in the bottom of the washing agent container beside the flow sleeve a rinsing passage connecting the washing agent container and the bolt tube, in which system by a shifting of the switching bolt from one stop position to the other the rinsing passage and the flow sleeve are connected by means of the bolt bore.

It is advantageous that the connecting piece is rotatably connected to an overthrow nut connectable with the casing.

It is further proposed that a check valve is arranged in the connecting part of the casing.

The invention provides the advantage that the device can be subsequently installed with simple means on any arbitrary shower head. A further substantial advantage lies in that because of its construction a clogging or a sticking in the exit to the hand held shower head by the emulsion cannot occur, since the gap for the emergence of the emulsion is automatically cleaned when the overthrow nut is removed for refilling. The device has, further, a large filling opening which becomes free by simple removal of a connecting piece.

BRIEF DESCRIPTION OF THE DRAWINGS

The invention is explained in detail in the following specification with the aid of an example of execution represented in the drawing.

FIG. 1 shows a longitudinal section through the device;

FIG. 2 a section along the line A—A in FIG. 1;

FIG. 3 a side view of FIG. 1, partly sectioned and

FIG. 4 a plan view of FIG. 3.

DESCRIPTION OF THE PREFERRED EMBODIMENT

The device has a container-type casing 1, in the middle of which there is arranged a water flow sleeve 2. At the water inlet end with the threaded nipple 3, a switching bolt 4 is provided which can be slid transversely to the flow sleeve 2. The washing agent annular cavity 5 is covered at its outlet end 6 by a connecting piece 7 which can be screwed onto the casing 1 with the aid of an overthrow nut 8.

The switching bolt 4 has a flow bore 9 which forms an extension of the water flow 10 in the flow sleeve 2. Toward the connecting threaded nipple 3 this bore 9 has a laterally-enlarged entrance 11. Further on in the bottom 12 of the washing agent annular cavity 5 immediately beside the flow sleeve 2 there is present a rinsing passage 13. In the casing 1 there is arranged a detent button 14 which seats in a depression in the bolt 4 to mark the switching position of the bolt 4 with a direct water flow through the flow sleeve 2. This position is recognizable in FIGS. 1 and 2. By a further shifting of the switching bolt 4 to the right as seen in FIGS. 1 and 2 the bore 9 connects both the water flow 10 and the rinsing passage 13, so that the rinsing agent in the annular cavity 5 is mixed under pressure with the shower water. The passage of the emulsion out of the annular cavity 5 occurs at a narrow gap 15 between cylindrical passage 16 of the connecting piece 7 and the flow sleeve 2. By a shifting of the switching bolt 4 to the left to the position shown in FIG. 1 the water flow through rinse passage 13 can be blocked. The respective settings are yielded by the detent button 14 guided in a groove 17 of the switching bolt 4.

In order to prevent a reflux of the washing agent, there is a check valve in the connecting threaded nipple 3.

The connecting piece 7 is turnably connected with the overthrow nut 8, for example by a snap connection 19 between these two parts 7,8, it being unnecessary to turn the hand held shower head for the screwing-on of the part 7. The connection of the part 7 with the casing 1 can then be made by a simple bayonet lock between the overthrow nut 8 and the casing 1.

I claim:

1. A device for apportioning washing agents in hand held shower heads, including a container casing (1) with an open end, a water inlet (3) to the container casing (1), a water flow sleeve (2) extending through the container casing (1), an annular washing agent cavity (5) located between the container casing (1) and the flow sleeve (2), an outlet cap assembly attached to the container casing (1) to close said open end thereof, said outlet cap assembly having a first member (7) with a cylindrical passage which surrounds said water flow sleeve and is spaced from said sleeve to create a gap (15) which provides an outlet for the washing agent cavity, a water inlet passage (13) for the washing agent cavity (5) leading to said container casing water inlet (3), a bolt (4) positioned between the water flow sleeve (2) and the water inlet (3), said bolt having a bore (9) extending therethrough with a wider entrance portion (11) adjacent the said water inlet, said bolt (4) being slidable between a first position in which said bore (9) connects the water inlet (3) with said water flow sleeve (2) and a second position in which the wider entrance portion (11) of the bore connects the casing water inlet (3) with said water inlet passage (13) for the washing agent cavity (5), and detent means (14) to hold the bolt selectively in its first and second positions.

2. Device according to claim 1, characterized in that the connecting piece (4) is turnably arranged on an overthrow nut (8) connectable with the casing (1).

3. Device according to claim 2, characterized in that in the connecting part (3) of the casing (1) there is arranged a check valve (18).

* * * * *